US007563495B2

(12) United States Patent
Anelli

(10) Patent No.: US 7,563,495 B2
(45) Date of Patent: Jul. 21, 2009

(54) FOOD CONTAINER

(75) Inventor: Matthew Anelli, Port Melbourne (AU)

(73) Assignee: Kraft Foods Global Brands LLC, Northfield, IL (US)

( * ) Notice: Subject to any disclaimer, the term of this patent is extended or adjusted under 35 U.S.C. 154(b) by 699 days.

(21) Appl. No.: 11/136,400

(22) Filed: May 25, 2005

(65) Prior Publication Data

US 2006/0280846 A1 Dec. 14, 2006

(51) Int. Cl.
*B31B 45/00* (2006.01)
*B32B 1/08* (2006.01)
*B65D 75/38* (2006.01)

(52) U.S. Cl. ..... 428/34.6; 426/122; 428/34.1

(58) Field of Classification Search ..... 426/122; 428/34.1, 34.6

See application file for complete search history.

(56) References Cited

U.S. PATENT DOCUMENTS 1,335,383 A * 3/1920 McColl et al. ..... 426/609
1,680,882 A 8/1928 Hollen
2,094,600 A 10/1937 Hothersall
2,331,901 A * 10/1943 Fisher ..... 229/5.5
2,760,430 A * 8/1956 Pauly ..... 100/248
3,144,167 A 8/1964 Schuktz
3,159,303 A 12/1964 Betner
3,285,461 A 11/1966 Santelli
3,318,495 A 5/1967 Roberts
3,347,411 A * 10/1967 Kalata et al. ..... 206/519
3,627,166 A * 12/1971 Walter ..... 220/270
4,142,453 A * 3/1979 Gidewall et al. ..... 493/100
4,311,255 A 1/1982 Meshberg
4,321,922 A 3/1982 Deaton
4,406,378 A 9/1983 Zysset
4,459,793 A 7/1984 Zenger
4,535,909 A 8/1985 Zysset
4,538,758 A 9/1985 Griffith
4,555,339 A 11/1985 Graves et al.
4,982,867 A 1/1991 Dubois et al.
5,052,573 A 10/1991 Zysset
5,069,356 A 12/1991 Zysset
5,236,102 A 8/1993 Quittmann et al.
6,076,693 A 6/2000 Reiter et al.
2003/0024930 A1* 2/2003 Smith et al. ..... 220/254.1
2003/0121233 A1 7/2003 Wallis
2003/0197016 A1 10/2003 Joseph
2004/0105917 A1* 6/2004 Mannion et al. ..... 426/110
2005/0115975 A1* 6/2005 Smith et al. ..... 220/592.17

FOREIGN PATENT DOCUMENTS

EP 0 122 336 A1 10/1984

* cited by examiner

*Primary Examiner*—Elizabeth M Cole
*Assistant Examiner*—Brent T O'Hern
(74) *Attorney, Agent, or Firm*—Fitch, Even, Tabin & Flannery

(57) ABSTRACT

A food container is provided which releases food contents thereof more easily and effectively. The food container includes an insert inserted into a metallic can before food product is filled therein and attachment of a closure end, where the insert provides an effective aid to product release by reducing or eliminating vacuum effects caused by hot-filling and cooling of the food product and/or wall adhesion effects between the food product and food container.

24 Claims, 5 Drawing Sheets

FOOD CONTAINER

FIELD OF THE INVENTION

This invention relates to food containers. More specifically, the present invention relates to a food container comprising a can and an insert positioned inside the can which provides an effective aid to food product release.

BACKGROUND OF THE INVENTION

A number of different types of can constructions have been developed for packaging food products. For instance, soldered or welded "three piece cans" are well known in which individual can body blanks are fed into a body maker where the cylinder is formed, seamed, and flanged, and then the bottom end is separately applied before filling the can, and the top end thereafter. "Two piece cans" are manufactured from thin sheets of aluminum or steel in which the can body and bottom end are integrally formed.

Steel has the advantage of being magnetic which facilitates recycling. Steel sheets for food containers are usually coated with a metal coat (tin or chrome), on which there is generally deposited an organic barrier coating. Two-piece steel containers are made by deep-drawing a steel blank under a blank holder in one (single draw) or more (draw-redraw) operations. The resulting open can structure has a cylindrical body and integral bottom end (maker's end), while the opposite end is open at this juncture. Thicknesses of steel sheets used for such can structures generally have ranged from about 0.08 mm to about 0.25 mm, although greater or smaller thicknesses have been used for particular applications. As the top end (customer's end) of the can, which is separately attached after filling the open can structure with food, a number of different can ends have been used, including round ends, non-round ends, pull-tab can ends, key-open ends, and foil laminated tinplate lids.

Pull-tab can ends for two-piece food cans are widely used. They are made from flat profile ends constructed of aluminum or steel. The ends are fed into a conversion press in which the end is scored, the flat profile modified with strengthening and convenience features and the rivet is formed. Tab stock is fed into the press where the pull tab is formed. The pull tab then advances to the modified basic end to which it is attached at the rivet. A pull-tab can end is seamed onto a can after it has been filled with food product with a closing machine. Closing machines are variously equipped to apply an end to a can after filling under a number of specific conditions dependent on the food product and the packer's needs such as vacuum closure, steam closure and vacuum gas closure. "Easy open ends" are a popular type of pull-tab can end allowing substantially complete removal of a panel covering an end of the container without the need to use a can opener or similar tool.

Many food products are hot-filled in two-piece container systems. Release problems have been experienced with two-piece metal cans hot-filled with certain food products. Food products, such as process cheeses, cheese spreads, and the like, can be conveniently filled in a hot molten state into the can. However, upon cooling and solidifying, these types of food products often tend to stick to and/or become "gripped" by the inner container wall. As a consequence, product users may need to use a utensil, such as a spoon, to tediously scrape off, scoop off, or otherwise manually separate and dislodge cheese portions from the inner container wall. As generally known in the packaging arts, when the hot-filled food contents of a closed container cool, they tend to shrink in volume, causing an internal partial vacuum effect in the container.

Condensation of moisture in headspace in the container can intensify the vacuum effect. The vacuum effect tends to create an inward pulling force on the container walls. Depending on the structural rigidity of the container wall, inward deformation or a slight collapsing of the container wall can occur due to the vacuum effect sufficient to cause the container wall to press upon and "grip" the food contents. Thin metal container walls in particular, once deformed in this manner, tend to stay deformed even after the food container is ultimately opened. Ideally, the food product would readily release from the inner container wall so that it can be served or dispensed more easily. The use of thicker and thus structurally more rigid metal container wall materials may reduce adverse consequences of vacuum effect, but has disadvantages of increasing packaging costs and possibly creating container forming problems.

SUMMARY OF THE INVENTION

The invention relates provides a food container which releases food contents more easily and effectively. The food container includes an insert that may be inserted into a can before filling food product therein and attaching a closure. The insert can provide an effective aid to food product release by reducing or eliminating vacuum effects caused by hot-filling and cooling of the food product and/or wall adhesion effects between the food product and food container.

In one embodiment, a food container comprises a metallic receptacle, the insert, and a closure. The metallic receptacle comprises a cylindrical body having an inner wall, a bottom end, and an open end opposite the bottom end. The insert releasably engages the inner wall and is supported upon the bottom end of the cylindrical body. A closure attached to the open end of the receptacle, includes a removable portion adapted to provide an access opening to food product within the container.

The insert preferably is a discrete component adapted to aid food product release by provisions in its structural geometry and material construction. In one particular embodiment, the insert comprises an open first end, a tubular portion, and a closed second end opposite the first end. The second end of the insert comprises a bottom, and a circumferential ridge extending down from the bottom and adapted to engage the bottom end of the receptacle to define a space between the receptacle bottom end and the insert bottom. The insert bottom, when at rest, is in a spaced orientation from the receptacle bottom end, and is adapted for displacement in the space relative to the receptacle bottom end when food contents are physically disturbed or removed from the container. The insert tubular portion is adapted to have a conformal positive fit with the cylinder inner wall when the insert bottom is at rest, but has reduced positive engagement with the inner wall when the food product is disturbed to aid product release.

In one embodiment, a physical disturbance of food product in the container by a consumer after opening the container results in vertical displacement of the insert bottom, which in turn effects a radial displacement of the tubular portion of the insert out of contact or at least into reduced positive contact with the inner wall of the metal receptacle. The result is that the vacuum effect is counteracted and food product is more easily released from the container.

The insert may comprise a polymeric construction, and preferably comprises a linear polyolefin construction to provide a useful balance of rigidity, flexibility, and heat tolerance adequate for hot-filling procedures. The polyolefin may be selected from the group consisting of polyethylene, polypropylene, and polybutylene. It is linear low density polyethylene in one preferred embodiment. These polymeric materials are effective for reducing wall adhesion effects between the food container and the food product.

In a particular embodiment, food containers incorporating the insert are especially useful for packaging hot-filled foods. These foods include meltable or flowable viscous food products, such as process cheese, cheese spread, and cream cheese. In another embodiment, the food container is a two-piece steel can construction including an easy open type end and which incorporates the insert providing assisted food release.

The figures are not necessarily drawn to scale. Similarly numbered elements in different figures represent like features unless indicated otherwise.

DETAILED DESCRIPTION OF THE PREFERRED EMBODIMENTS

In preferred embodiments, the present invention provides easy and effective food product release from metal containers. It is particularly useful for assisting product release of hot-filled and cooled food products from metal can type packaging.

Figure 1:
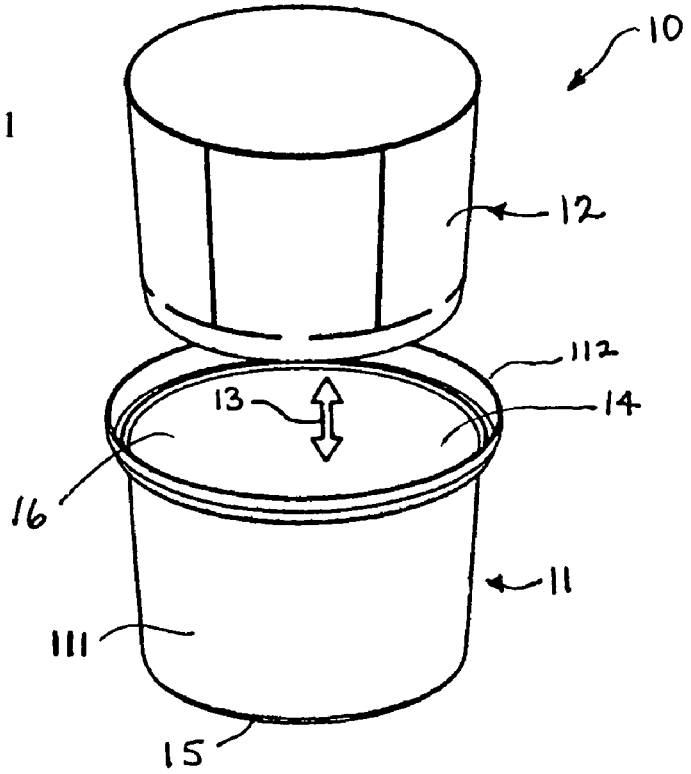
FIG. 1 is an exploded partial view of a food container including an insert and open can part according to an embodiment of the invention.

Referring to FIG. 1, a food container 10 having an open can part 11 and an insert 12 is shown in accordance with an embodiment herein. In this illustration, a can closure is not shown, but it will be understood that such a part typically will be attached to open end of the filled can part 11 as part of the food packaging operation.

The insert 12 is configured with a geometry and a material construction which provides flexural properties which reduce or even eliminate food "gripping" problems associated with vacuum effect arising from food product hot-filling and cooling. The insert 12 also is constructed of a polymeric material which is less susceptible than metal materials to sticking to hot-filled food materials, which further aids product release. Food product release is made possible from a metal can, and a steel can in particular, without the need to use a scraping utensil or tool of some kind.

As indicated in FIG. 1, the insert 12 is nested inside the open can part 11 in the direction of arrow 13. The open can part 11 is a metallic receptacle comprising cylindrical body 111 having an inner wall 14, a solid bottom end 15, and an open end 16 opposite the bottom end 15. The open can part 11 may be constructed of steel or aluminum sheeting in accordance with conventional can forming procedures. It may have a thickness ranging from about 0.08 mm to about 0.25 mm, or other formable thickness. Steel sheets, if used, may be coated with a metal coat (tin or chrome), on which there is generally deposited an organic barrier coating, in accordance with conventional known procedures.

The insert 12 has a flexible yet self-supporting polymeric construction. The insert 12 preferably is constructed of a resilient thin plastic material. When initially inserted into the open can part 11 and when filled with food, the insert 12 has a conformal and positive fit to the inner wall 14 of the open can part 11, as its normal or equilibrated structural position. The term "positive fit" means that the parts are sized such that they frictionally engage each other as the insert 12 is pushed inside the open can part 11, and thus the insert normally tends to stay in conformal contact with and around the circumference of the inner wall 14 of the open can part 11, unless the positive fit therebetween is relieved. After the can is opened so that food can be removed from the open can part 11, the positive fit between the insert 12 and open can part 11 is temporarily relieved as the insert structure is configured to dynamically react to manipulation of the food contents held inside in a manner aiding product release, as explained in greater detail below. Open can part 11 has an upper end 112 which can be flanged and interlocked with a closure, such as by double seaming, in accordance with a conventional procedure, after the container is fitted with the insert 12 and hot-filled with food product. The upper end 112 of open can part 11 also includes a rim or ledge portion 114 used for seating a flanged end 61 of the insert 12, such as in a manner shown in more detail in FIGS. 10-11.

Figure 2:
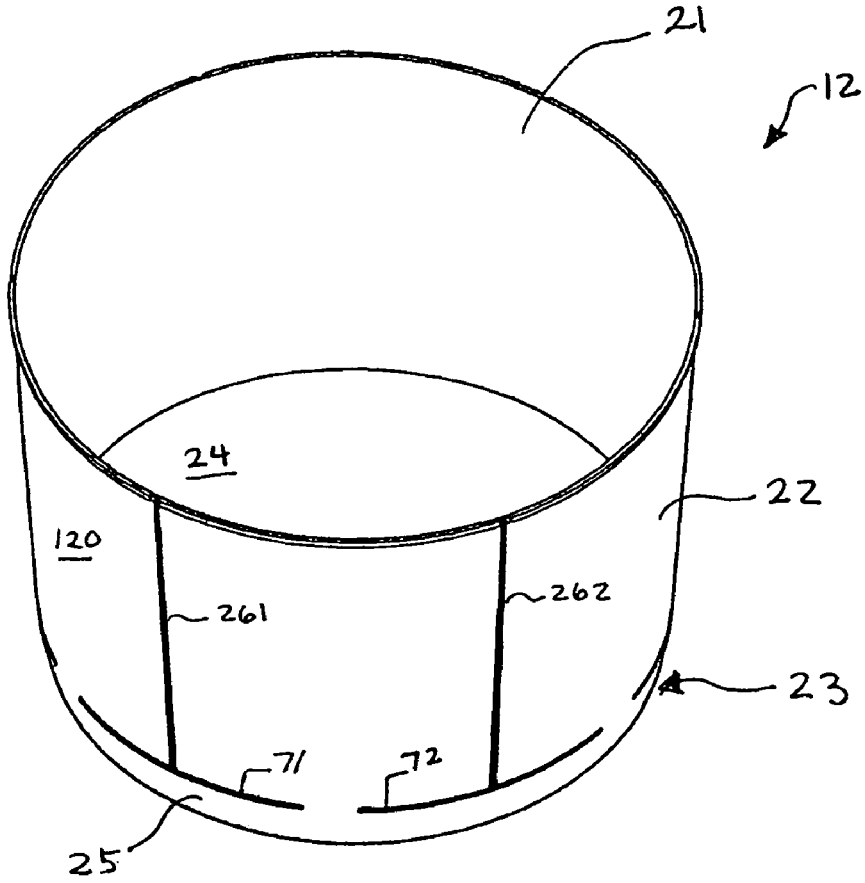
FIG. 2 is an enlarged isolated view of the insert component of the food container shown in FIG. 1.

Referring to FIG. 2, the insert 12 comprises an open first end 21, a tubular portion 22, and a closed second end 23 opposite the first end 21. The second end 23 serves as a base for the component and comprises a bottom 24 extending generally horizontally, and a circumferential ridge 25 that extends generally vertically downward from the bottom 24. A plurality of longitudinal grooves 261, 262, etc., are provided in the outer surface 120 of the insert 12. The grooves preferably are equidistantly spaced around the circumference of the insert 12. The grooves render the tubular portion 22 of the insert more flexible and operable to break pressing contact with the confronting inner wall 14 of the open can part 11. The number of grooves provided in insert 12 may number from about three to about nine, depending on the insert construction. For instance, stiffer insert materials may require provision of more grooves to impart the requisite flexibility. In one embodiment, the insert 12 is constructed of a material and has a structure able to withstand hot-filling temperature conditions exceeding about 80° C.

Figure 3:
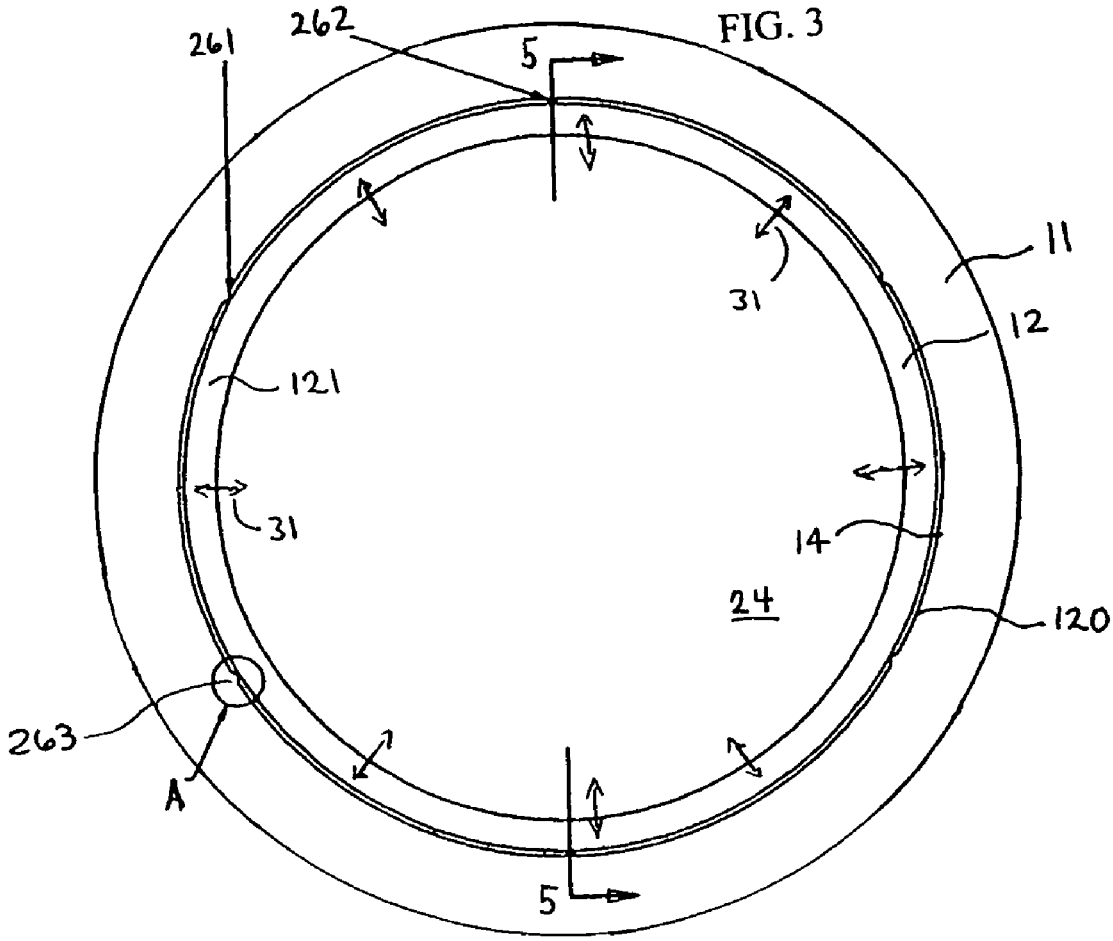
FIG. 3 is a plan view of the food container of FIG. 1 with the insert shown as nested within the open can part.

Referring to FIG. 3, insert 12 is shown in its nested position inside open can part 11. In this illustration, six grooves 261, 262, 263, etc., are formed in the outer surface 120 of insert 12 at 60° intervals around the circumference of the component. Arrows 31 indicate a reversible direction of radial displacement to which a tubular portion 121 of the insert 12 is adapted to move in conjunction with displacement of the insert bottom 24 which can occur, e.g., during removal of food contents from the container. The flexure of the insert tubular portion 121 brings it temporarily out of contact, respectively, with the inner wall 14 of the open can part 11. When brought out of contact, compressive or gripping forces brought to bear by the container inner wall 14 upon outer surface 120 of insert 12, such as those associated with any vacuum effect created during hot-filling and cooling, are temporarily relieved which aids release and removal of the food contents from the container.

Figure 4:
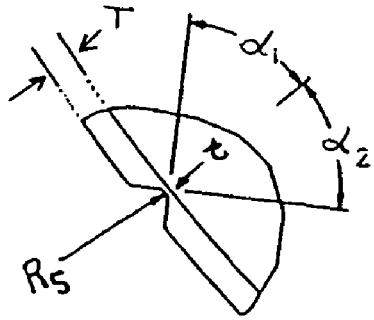
FIG. 4 is an enlarged view of insert detail A in FIG. 3.

Referring to FIG. 4, an enlarged view of groove 263, which is representative of all six of the grooves, is shown formed with sides inclined at acute angles $\alpha_1$, and $\alpha_2$. The grooves provided in insert 12 must be deep enough to impart enhanced structural flexibility such that the component can be temporarily displaced in a radial direction 31, while not so deep that structural failure may arise or that the part lacks sufficient rebound and resiliency properties for its desired manner of functioning.

Figure 5:
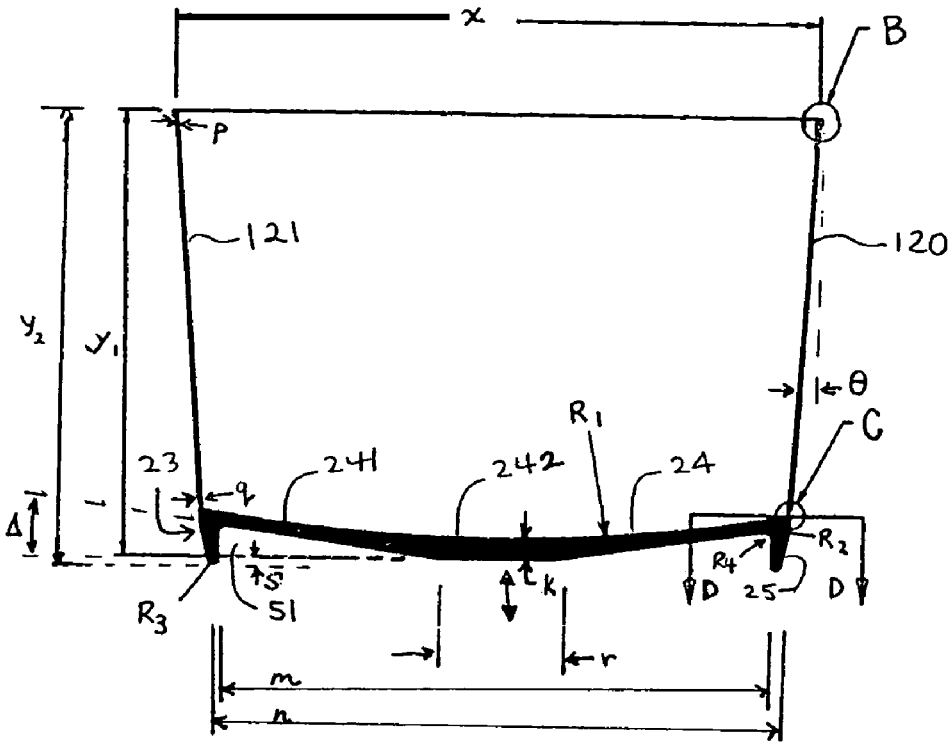
FIG. 5 is a partial sectional view taken along line 5-5 of the insert component of the insert component of the food container shown in FIG. 3.

Referring to FIG. 5, the tubular portion 121 of the insert has a tapered diameter which decreases in a direction extending from the open first end 21 to the bottom second end 23 thereof. The base end 23 of the insert 12 includes bottom 24 and a circumferential ridge 25. The ridge 25 is adapted to sit upon the upper face of the bottom end 15 of the open can part 11. The bottom 24 of insert 12 has a diaphragm-like construction and behavior. The base end 23 ensures responsiveness to a relatively flexible metallic can base. The insert 12 is nested into the can prior to filling and has a base end 12 sufficiently robust enough to withstand any radial inversion and provide necessary displacement for food release. A space 51 is created between the bottom end 15 of open can part 11 and the insert bottom 24 when the insert 12 is nested within open can part 11.

Figure 6:
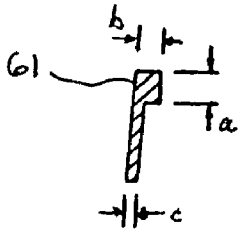
FIG. 6 is an enlarged view of insert detail B in FIG. 5.
Figure 7:
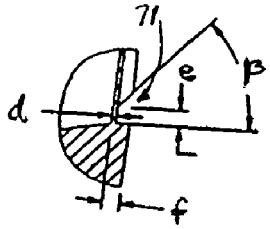
FIG. 7 is an enlarged view of insert detail C in FIG. 5.
Figure 8:
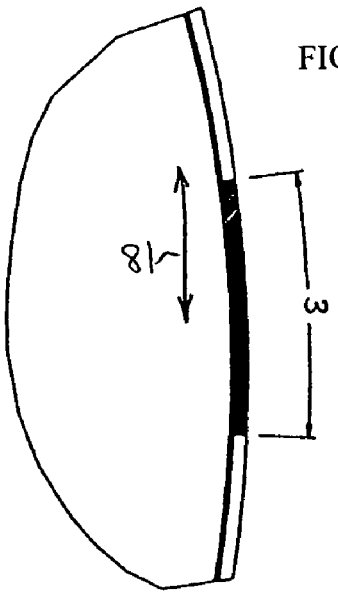
FIG. 8 is an enlarged sectional view taken along line D-D in FIG. 5.

Referring to FIG. 6, the flanged upper end 61 is shown in more detail. Flanged upper end 61 has a shape by which it can be seated on a rim surface 111 provided near, but not at, the upper end of the open can part 11 (e.g., see FIGS. 10-11). Referring to FIG. 7, the outer sidewall 120 of the tubular portion 121 of the insert has an arcuate notch 71 provided where tubular portion 121 meets the bottom 24 thereof. As shown in FIG. 4, a transverse groove 71 extends generally perpendicularly to and intersects the lower end of one of the longitudinal grooves 261 formed in the same outer surface 120 of the insert 12. Preferably, a transverse groove 71, 72, etc., intersects each longitudinal groove 261, 262, etc., in this manner. Notches 71, 72, etc. further increase the flexibility of the tubular portion 121 and its ability to displace radially relative to adjoining inner walls of the container in conjunction with vertical movement of base 24. Referring to FIG. 8, the groove 71 is shown to have an arc distance $\omega$ along the circumferential direction 81 of the tubular portion 121.

The flexible bottom 24 of the insert comprises an annular outer region 241 surrounding a central region 242 having a relatively larger thickness than the annular region 241. This creates a flexible diaphragm-like construction. The insert bottom 24, when at rest, is in a spaced orientation from the bottom end of the open can part 11. The term "at rest" as used herein refers to the normal equilibrium position of a structural component in the absence of external force being applied to the food contents and/or insert of the container by a consumer during food dispensing. The insert bottom 24 is adapted to be vertically displaceable in space 51 relative to the open can part bottom end 15 when food contents of the container are physically manipulated or removed by a consumer, such using a utensil. Vertical displacement of insert bottom 24, in turn, acts to pull and radially displace the insert tubular portion 121 inward away from the inner wall 14 of open can part 11. As discussed above, the insert tubular portion 121 is adapted to have positive conformal fit with the inner wall 14 of the open can part when the insert flexible bottom 24 is at rest. However, the tubular portion 121 is adapted to have reduced positive engagement with the inner wall 14 to aid product release therefrom when the insert bottom 24 is vertically displaced. This mechanism counter-acts vacuum effect and thusly aids food product release from the insert 12.

The insert 12 also is capable of reducing or eliminating wall adhesion effects. Certain hot-filled food products, such as process cheese, cheese spreads, cream cheeses, etc., are relatively sticky (i.e., tacky) relative to the inner metal container walls during and/or after solidification upon cooling. These types of foods also are susceptible to vacuum effects. These types of foods can become attached to the inner container walls at their interface via adhesive forces in addition to or separate from any vacuum effect issues. The insert 12 is constructed of a polymeric material which is generally less tacky relative to these food materials as compared to metallic surfaces typically encountered in two-piece can constructions, such as steel cans, aluminum cans, and barrier coated-metal cans. Suitable polymeric materials for constructing the insert are described in more detail below.

In one example, and with reference to structural features indicated in FIGS. 4-8, a polymeric insert 12 may be constructed providing the above-indicated advantages which has the dimensions indicated in Table 1 below, when used in combination with a cylindrical-shaped open steel can constructed from steel sheeting, which may include, e.g., thickness gages ordinarily used for can steel construction, and having an inner diameter of 58.7 mm. $R_1$ to $R_5$ refer to radii of curvature.

TABLE 1

| Insert Dimension | Value |
|---|---|
| $\alpha_1$ | 45° |
| $\alpha_2$ | 45° |
| $\theta$ | 3.6° |
| $\Delta$ | 8.5° |
| $\beta$ | 45° |
| $\omega$ | 10° |
| a | 0.6 mm |
| b | 0.45 mm |
| c | 0.2 mm |
| d | 0.08 mm |
| e | 0.3 mm |
| f | 0.33 mm |
| k | 2.0 mm |
| n | 52.6 mm |
| m | 51.0 mm |
| p | 0.2 mm |
| q | 0.33 mm |
| r | 11.5 mm |
| $R_1$ | 150 mm |
| $R_2$ | 10 mm |
| $R_3$ | 0.5 mm |
| $R_4$ | 0.8 mm |
| $R_5$ | 0.18 mm |
| s | 0.75 mm |
| x | 58.7 mm |
| $y_1$ | 41.5 mm |
| $y_2$ | 42.25 mm |

The insert 12 is constructed of a food grade polymeric material having the requisite structural and chemical properties. The polymeric material may be a thermoplastic, thermosetting, or elastomeric material to the extent it can be molded or otherwise shaped into a discrete, self-supporting "cup-like" shape having the requisite structural properties indicated herein. In one embodiment, the polymeric material is thermoplastic, and in particular a polyolefinic thermoplastic selected from the group consisting of polyethylene, polypropylene, and polybutylene.

The insert material should be chemically inert relative to the foodstuff packed in the container during filling and the applicable shelf life. In one preferred embodiment, the insert material is low density polyethylene (LDPE), and more particularly a linear low density polyethylene (LLDPE). As understood in the polymer field, the crystallinity of conventional low-density polyethylene (LDPE) is lower than LLDPE due to the frequent long chain branches in the former which are formed during the high pressure catalyzed-polymerization of an ethylene monomer. In LLDPE production, relatively frequent short chain branches only are formed by copolymerizing ethylene at low pressures and in the presence of catalysts with small amounts of α-olefin comonomers (viz., butene, hexene, octene), which play the role of uniform short branches along a nearly linear backbone. LLDPE forms a more highly crystalline structure due to the absence of long chain branching, which results in increased stiffness and an increased melting point by about 10-15° C. as compared to LDPE. LLDPE resins generally have crystallinity from about 35% to about 60%. As the molecular weight of LLDPE increases, there typically is an increase in chemical resistance, tensile strength, stiffness and environmental stress crack resistance (ESCR). The density of LLDPE is determined by the concentration of the co-monomer in the polyethylene chain. The higher the co-monomer concentration, the lower the density of the resin. As the density increases, there is an increase in chemical resistance, tensile strength, and stiffness, but a decrease in ESCR and permeability. When hexene or octene co-monomer is used instead of butene, there is a significant increase in impact strength and tear properties. While traditionally LLDPE has been produced using Ziegler-type catalysts, newer technology based on metallocene catalysts allows production of LLDPE grades with enhanced properties such as narrower molecular weight distribution, improved co-monomer distribution, improved film clarity, better sealability, enhanced impact strength. LLDPE differs from high density polyethylene (HDPE) in the number of short chain branches, where HDPE has a smaller number thereof which results in a higher density material than LLDPE. Preferably, LLDPE is used which has a relatively narrow molecular weight distribution.

LDPE, including injection grade LLDPE, is commercially available, such as LLDPE products supplied under the following tradenames, Dow DOWLEX, Nova Chemicals SCLAIR, Equistar PETROTHENE, ExxonMobil LL 6301 series, Huntsman REXELL, Network Polymers Inc. NPP, UBE UMERIT Metallocene, and so forth.

In one particular embodiment, the insert material is LLDPE has the properties indicated in Table 2 below.

TABLE 2

| Property | Range Value | Typical Value |
|---|---|---|
| Density | 0.917-0.965 g/cc | 0.933 g/cc |
| water absorption | 0.01% | — |
| linear mold shrinkage | 0.014-0.02 cm/cm | — |
| transverse linear mold shrinkage | 0.010-0.014 cm/cm | — |
| melt flow index | 4.5-150 g/10 min | 53 g/10 min |
| spiral flow | 32-68 cm | 47 cm |
| Hardness, Shore D | 52-59 | 55 |
| tensile strength, ultimate | 8.2-15.2 MPa | 10.1 MPa |
| elongation at break | 75-910% | 500% |
| tensile modulus | 150-1,000 MPa | 320 MPa |

TABLE 2-continued

| Property | Range Value | Typical Value |
|---|---|---|
| flexural modulus | 211-827 MPa | 490 MPa |
| tensile impact strength | 70-80 kJ/m$^2$ | — |
| tensile creep modulus, 1000 hrs. | 280-300 MPa | — |
| IZOD impact | 2.9-9.7 J/cm | 4.6 J/cm |
| environmental stress crack resistance | 1-175 hrs. | 20 hrs. |
| peak melting point | 120-140° C. | 130° C. |
| CTE, linear 20° C. | 160-170 μm/m-° C. | — |
| deflection temperature at 0.46 MPa | 47-75° C. | 53° C. |
| Vicat softening point | 74-101° C. | 93° C. |

The insert 12 may be formed into the desired structural shape and from the polymeric materials described herein using standard polymeric molding techniques, and particularly via injection molding. The injection molding process generally involves the rapid pressure filling of a specific mold cavity with a flowable resin material, followed by solidification of the material into a shaped product. The injection molding machine may be a reciprocating screw type, or other suitable injection molding system. An interchangeable injection molding tool, the mold, provides a cavity corresponding to the desired geometry of the insert and permits the removal of the insert after its solidification (ejection). Conventional arrangements for these functions may be used. For instance, a multiplate multicavity mold may be used including, for example, a moving mold half and a stationary mold half. In a closed or injection configuration, flowable resin is introduced into the internal cavity defined by the mold plates through at least one sprue and a runner, and after solidification of the injected resin, the mold is opened and then the molded part is removed from the mold, such via ejectors, e.g., knock-out pins moved by a drive mechanism through an ejector plate. The injection molding machine may have a computer-based control system. Suitable commercially-available injection grade LLDPE resins generally have processing temperatures of about 190 to about 275° C.

In one particular embodiment, the present invention relates to a combination of a cup insert such as described above and a two-piece easy-open steel can.

Figure 9:
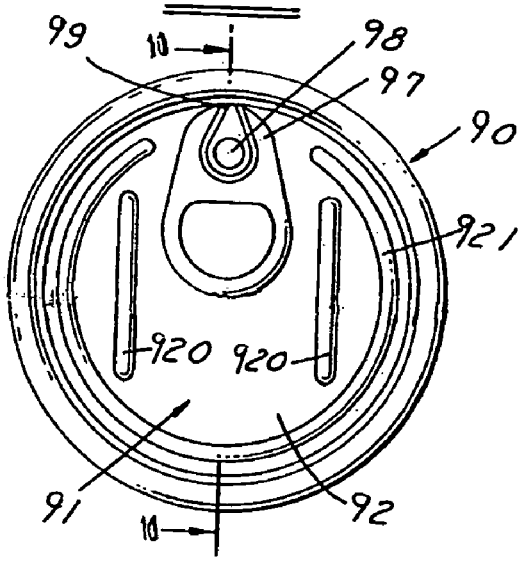
FIG. 9 is a plan view of a closure end of the food container of FIG. 1 according to an embodiment of the present invention.
Figure 10:
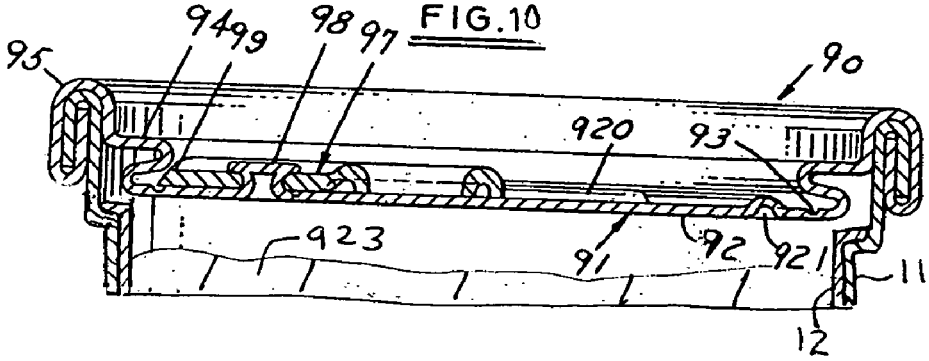
FIG. 10 is a fragmentary sectional view taken along the line 10-10 in FIG. 9.
Figure 11:
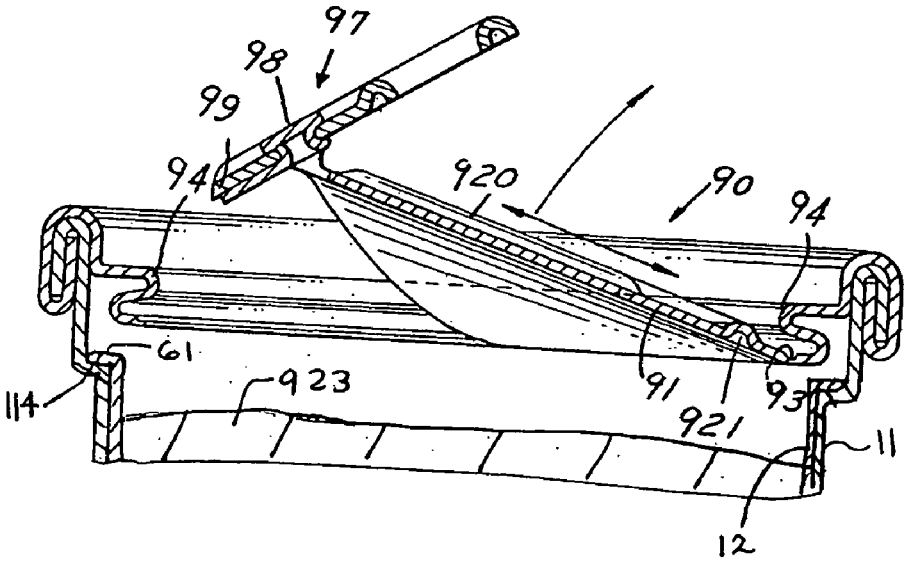
FIG. 11 is a view similar to FIG. 10 showing the opening of the container.

Referring to FIGS. 9-11, a metallic closure 90 is illustrated which can be assembled with container 10 to provide a two-piece can construction. The assembly of the two-piece can be performed generally in a conventional manner with the modification that the open can part will have been pre-assembled with an insert as described herein. Closure 90 comprises a metallic panel 91 with a central removable portion 92 defined by endless score line 93, a peripheral fixed portion comprising an integrity safety bead 94 overlying the score line 93, and an annular channel portion 95 whereby the closure can be double-seamed to the top of a cylindrical container 11 such as described above. The closure 90 includes a pull-tab 97 extending generally radially and fastened to the removable panel portion by a rivet 98. The pull-tab 97 includes a nose portion 99 that is movable adjacent the score line 93 when the pull-tab 97 is lifted by hand causing the severing of the panel at the score line 93. Further pulling of the tab 97 in the direction of the arrow completes the severing and removal of the panel.

In this illustration stiffening means are included in the form of parallel straight integral beads 920 formed upraised from the plane of the removable panel are provided and extend generally parallel to the opening direction, that is, parallel to the longitudinal axis of the pull-tab 97 on the removable portion 92 of the panel 91. The stiffening beads 920 extend from adjacent one edge of the removable portion to the other edge adjacent the score line 93 preferably as close as possible to the score line 93 without deforming or rupturing the score line in the manufacturing process. The removable portion also includes an arcuate bead 921 extending throughout substantially the entire periphery thereof.

As shown in FIG. 11 when the pull-tab 97 is lifted to puncture and sever the score line 93, the removable portion 92 of the panel is lifted. The stiffening beads 20 stiffen the removable portion 91 in the direction of the double arrow shown. in FIG. 11 to counteract the tendency for the panel to bend in the direction of the pull. At the same time, the beads tend to facilitate upward bending or bowing of the removable portion 91 of the panel in the direction transverse to the direction of the pull so that the removable portion can be readily removed without interference from the safety bead 94. Commercial easy open ends that may be used include, for example, QUICKTOPS® manufactured by Silgan Containers Corporation. Food product 923, such as previously hot-filled and cooled process cheese, is also indicated in FIGS. 10-11.

Although not shown in FIGS. 9-11, it will appreciated that the canned food product can include a plastic lid removably attached upon the closure, which can be used to reclose the can for further storage after a consumer removes the easy open closure and serves some of the food contents, but desires to store the unused remainder of the food contents for later consumption, in accordance with a conventional arrangement.

Figure 12:
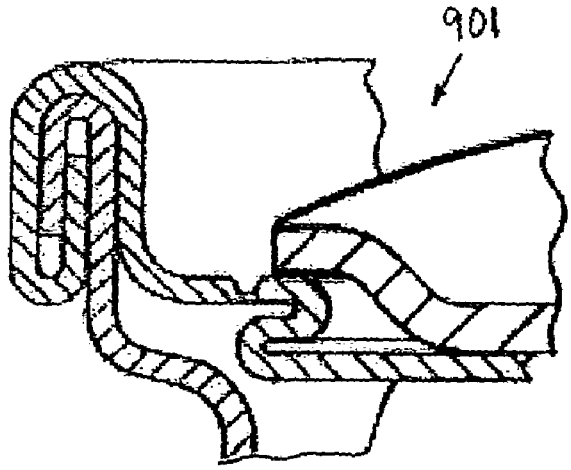
FIG. 12 is a sectional view of alternative closure end that may be used with the food container.
Figure 13:
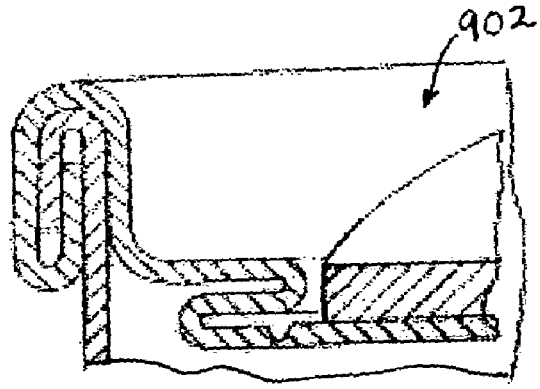
FIG. 13 is a sectional view of another alternative closure end that may be used with the food container.
Figure 14:
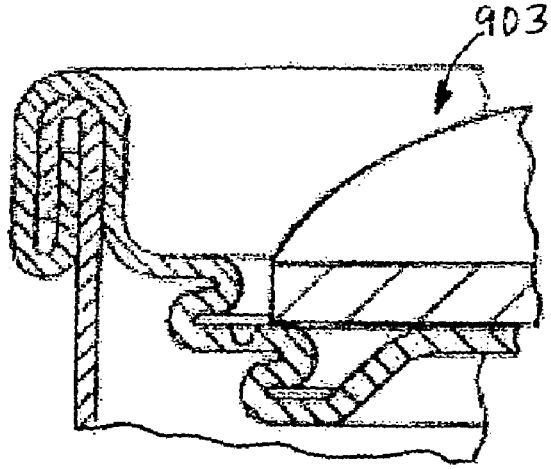
FIG. 14 is a sectional view of yet another alternative closure end that may be used with the food container.

It also will be appreciated that the removable end configuration is not necessarily limited to the above-illustrated scheme. Other known or suitable easy open full panel removable end configurations for can closures may be used. For instance, the closure configuration may be a "triplefold" center panel protection arrangement 901 (FIG. 12), a SAFERIM configuration 902 developed by Owens-Illinois, Inc. (FIG. 13), or a DOUBLESAFE configuration 903 developed by Owens-Illinois, Inc. and now made by Automated Container Corporations (FIG. 14), among others. To simplify the illustrations of these alternatives, they are shown without the insert, which would be associated therewith in a similar manner as shown in prior FIGS. 10-11.

As used herein the term "process cheese" includes those products known and referred to as pasteurized process cheese, process cheese food, and process cheese spread, as those terms are defined in the U.S. Federal Standards of Identity, and also products resembling any of these in flavor and texture but which may not meet the U.S. Federal Standards of Identity for any of the above products in that they contain ingredients not specified by the Standards, such as vegetable oil or vegetable protein, or do not meet the compositional or any other requirements of such Standards.

While the invention has been particularly described with specific reference to particular embodiments, it will be appreciated that various alterations, modifications and adaptations may be based on the present disclosure, and are intended to be within the spirit and scope of the present invention as defined by the following claims.

What is claimed is:

1. A food container, comprising:

a receptacle comprising a cylindrical body having an inner wall, a bottom end, and an open end opposite the bottom end;

an insert releasably and frictionally engaging the inner wall and supported upon the bottom end of the cylindrical body, wherein the insert has an open first end, a tubular portion and a closed second end opposite the first end and having a bottom, a circumferential ridge extending downward from the bottom and engaging the bottom end of the receptacle to define a space between the bottom end of the receptacle and the bottom of the insert;

a closure attached to the open end of the receptacle, which includes a removable portion adapted to provide an access opening to food product contained within the container, wherein the insert is adapted by having the bottom of the insert configured as a diaphragm movable relative to the bottom end of the receptacle to reduce frictional engagement of the insert with the inner wall of the receptacle to aid food product release from the food container when food product contained therein is being removed;

wherein the insert bottom comprises an annular outer region surrounding a central region having a greater thickness than the annular region; and wherein the insert tubular portion has a circumference and includes a plurality of longitudinally-extending grooves which are substantially equidistantly spaced around the circumference, and a plurality of transverse grooves wherein a transverse groove extends generally perpendicularly to and intersects a lower end of each of the longitudinal grooves.

2. The food container of claim 1, wherein the insert tubular portion has an inward tapering diameter in a direction from the first end to the second end.

3. The food container of claim 1, wherein the insert comprises a polymeric construction.

4. The food container of claim 3, wherein the polymeric construction comprises a thermoplastic.

5. The food container of claim 4, wherein the thermoplastic comprises a polyolefin.

6. The food container of claim 5, wherein polyolefin is selected from the group consisting of polyethylene, polypropylene, and polybutylene.

7. The food container of claim 5, wherein the polyolefin comprises linear low density polyethylene.

8. A food container having an easy opening end, comprising:

a metallic receptacle having a cylindrical body having an inner wall, a bottom end, and an open end opposite the bottom end;

an insert releasably engaging the inner wall and supported upon the bottom end of the cylindrical body, wherein the insert has an open first end, a tubular portion and a closed second end opposite the first end and having a bottom, a circumferential ridge of the insert extending downward from the bottom and engaging the bottom end of the receptacle to define a space between the bottom end of the receptacle and the bottom of the insert;

food product contained within the insert; and a closure attached to the open end of the receptacle, wherein the closure includes a panel including a weakened score line, the severing of which provides an access opening therethrough which allows access to the food product held within the insert, wherein the insert is adapted by having a plurality of longitudinally extending grooves disposed about an outwardly facing surface of the tubular portion of the insert and a smooth inwardly facing surface, the tubular portion is inwardly moveable to at least partially release the insert from engaging the inner wall of the receptacle to aid food product release from the food container when food product contained therein is being removed, wherein the insert bottom comprises an annular outer region surrounding a central region having a larger thickness than the annular region, and wherein the insert tubular portion has a circumference, and the plurality of longitudinally-extending grooves are substantially equidistantly spaced around the circumference, and wherein the insert tubular portion has a plurality of transverse grooves, wherein a transverse groove extends generally perpendicularly to and intersects a lower end of each of the longitudinal grooves.

9. The food container of claim 8, wherein the metallic receptacle comprises a metallic material selected from steel and aluminum.

10. The food container of claim 8, wherein the metallic receptacle comprises steel.

11. The food container of claim 8, wherein the closure further comprises a fastener joined to said panel and spaced from said score line, and a pull tab joined to said fastener and having a pull ring extending from said fastener in a direction away from said score line and a nose portion extending adjacent to said score line to permit the severing of said score line upon pulling of said pull ring in a direction away from said container end.

12. The food container of claim 8, wherein the food product comprises a cheese product which can be hot-filled.

13. The food container of claim 8, wherein the food product is selected from the group consisting of process cheese, cheese spread, and cream cheese.

14. The food container of claim 8, wherein the food product comprises process cheese.

15. The food container of claim 8, wherein the insert bottom when at rest is in a spaced orientation from the receptacle bottom end, and wherein the bottom is adapted to be vertically displaceable relative to the receptacle bottom end.

16. The food container of claim 15, wherein the insert tubular portion is adapted to have positive conformal fit with the cylinder inner wall when the insert bottom is at rest, and wherein the tubular portion is adapted to have reduced positive engagement with the inner wall to aid product release therefrom when the insert bottom panel is vertically displaced.

17. The food container of claim 15, wherein the insert tubular portion has an inward tapering diameter in a direction from the first end to the second end.

18. The food container of claim 8, wherein the insert comprises a polymeric construction.

19. The food container of claim 18, wherein the polymeric construction comprises a thermoplastic.

20. The food container of claim 19, wherein the thermoplastic comprises a polyolefin.

21. The food container of claim 20, wherein the polyolefin is selected from the group consisting of polyethylene, polypropylene, and polybutylene.

22. The food container of claim 20, wherein the polyolefin comprises linear low density polyethylene.

23. The food container of claim 1, wherein the plurality of longitudinally-extending grooves are on an outwardly-facing surface of the insert tubular portion.

24. The food container of claim 23, wherein the plurality of transverse grooves are on the outwardly facing surface of the insert tubular portion.

* * * * *